US006315443B1

(12) United States Patent
Meyrat et al.

(10) Patent No.: US 6,315,443 B1
(45) Date of Patent: Nov. 13, 2001

(54) PRECIOUS METAL CHRONOGRAPH WATCH WITH A HOLLOWED MIDDLE PART-BEZEL

(75) Inventors: Clément Meyrat, Le Landeron; Olivier Silvant, Macolin, both of (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/594,717

(22) Filed: Jun. 16, 2000

(30) Foreign Application Priority Data

Jun. 29, 1999 (EP) ..... 99112394

(51) Int. Cl.[7] ..... G04B 29/00
(52) U.S. Cl. ..... 368/290; 368/288; 368/320
(58) Field of Search ..... 368/319–321, 368/288–290

(56) References Cited

U.S. PATENT DOCUMENTS 4,408,901 * 10/1983 Gagnebin ..... 368/321
5,257,247 * 10/1993 Miche et al. ..... 368/290
5,363,350 11/1994 Marr-Andréet al. .
5,493,544 2/1996 Marthe .

FOREIGN PATENT DOCUMENTS 0 716 360 6/1996 (EP) .
1 374 708 11/1974 (GB) .

* cited by examiner

*Primary Examiner*—Bernard Roskoski
(74) *Attorney, Agent, or Firm*—Griffin & Szipl, P.C.

(57) ABSTRACT

The invention concerns a chronograph watch made of precious metal including a case (1), closed by a crystal (12) and a back cover (13) resting on a rigid middle part-bezel (20) having a recess (19) opening towards the center of the case and wherein are provided through passages (3, 25) for a time-setting stem (4) and for guide sleeves (50) for at least two push buttons (2), and a chronograph movement (5) with its display device (6, 7, 8) positioned in said case by a casing ring (40) arranged between said movement (5) and said middle part-bezel (20), characterized in that the guide sleeves (50) include a tube (55) threaded on the outside and which ends in a collar (56) and in that at least two separated segments (30) shaped substantially like the recess (19) and pierced with a threaded hole (35) are arranged facing the push button (2) sleeves (50) to assure, by screwing from the exterior, both that said segments (30) are firmly positioned and that said sleeves (50) are sealed by crushing a metal ring (26) of the middle part-bezel (20) around the through passages (25).

7 Claims, 3 Drawing Sheets

PRECIOUS METAL CHRONOGRAPH WATCH WITH A HOLLOWED MIDDLE PART-BEZEL

The present invention concerns a chronograph watch case having a middle part-bezel made of precious metal including a recess in which are arranged in various locations segments of base material for the functional purpose of allowing other constituent parts of said chronograph watch to be assembled and assuring the sealing or water resistance of the winding stem passages.

When a middle part or middle part-bezel is made of precious metal, such as gold or platinum, it is economically advantageous to have the thinnest possible covering, which has, however, the disadvantageous of being easily deformed under the effect of a shock or pressure. "Covering" is used in the present invention to mean a structure which is sufficiently rigid to be handled and not simply a metal plating of several tens of microns on a support structure of base material already constituting the middle part or middle part-bezel. Within the meaning of the present invention, such a "covering" is for example obtained in a known manner by the electroforming technique which allows complex shapes of thickness which may vary from several tens of microns to several hundreds of microns to be obtained.

When the thickness of the covering is too small, for example of the order of 150 to 200 $\mu$m, reinforcement means have to be provided, arranged in the entire recess to protect the outer wall against shocks or pressure.

In the Swiss Patent No. CH-A-79203, such reinforcement is obtained by means of several segments having the same profile as the inner wall of the middle part, said segments being applied when assembled against said wall by means of a truncated casing ring. In the more recent U.S. Pat. No. 5,363,350, four segments covering at least 85% of the periphery of the recess are held in place, either by elastic means arranged in a groove over the entire periphery or at various locations, either by flanges screwed in the vicinity of the passage of the winding stem. In either case, these segments, which are made of base metal or a alloy such as brass, have practically no mechanical function other than reinforcement and above all increase the weight of the timepiece, which has the drawback of making it appear to be made of precious metal, or solid platinum.

In U.S. Pat. No. 4,995,023, the reinforcement of a wall of 150 $\mu$m is obtained by stiffening elements which are integral with the wall and have a local thickness of 650 $\mu$m, thus giving the recess an alveolar structure. Such as structure, which is also called a "honeycomb" structure, is also described in European Patent No. EP 0 762 240. This structure has the drawback of unnecessarily using a large quantity of precious metal, while giving the timepiece an apparent lightness which could lead one to doubt that it is made of precious metal.

In U.S. Pat. No. 4,970,708, it will be observed that the three inserts secured by bonding or welding in the recess of the middle part in the shape of an arch no longer have a reinforcing function, but an assembly function consisting in axially positioning the other constituent parts of the watch. It appears however that assembly by bonding or welding is not totally satisfactory, in particular for timepieces which merit a hallmark.

It will be observed finally that all the timepieces to which reference is made in the aforecited documents are watches whose middle part has only one opening or hole for the passage of the winding stem.

The present invention however concerns a chronograph watch made of precious metal, i.e. a timepiece including not only a stem but also at least two push buttons and whose hollowed middle part-bezel is of sufficient thickness to resist external pressure or shocks, but insufficient thickness to allow mechanical assembly of all the components necessary for the construction of said chronograph watch. The object of the invention is thus to provide an arrangement allowing such an assembly to be made economically with a reduced number of parts.

The invention therefore concerns a chronograph watch made of precious metal including a case, closed by a crystal and a back cover resting on a rigid middle part-bezel having a opened recess opening towards the centre of the case and wherein are provided through passages for a time-setting stem and for guide sleeves for at least two push buttons, and a chronograph movement with its display device positioned in said case by a casing ring arranged between said movement and said middle part-bezel. This chronograph watch is characterised in that the guide sleeves include a tube threaded on the outside and which ends in a collar and in that at least two out-of-joint segments shaped substantially like the recess and pierced with a threaded hole are arranged facing the push button sleeves to allow, by screwing from the exterior, both said segments to be firmly positioned and said sleeves to be sealed by crushing a metal ring of the middle part-bezel around the through passages.

These segments held in place by the sleeves also have other functional aspects in particular as regards the positioning and securing of the casing ring in which a pre-assembled movement, which also includes the dial and the hands, will be introduced from the back cover side.

One of these segments, in its top portion, on the crystal side, is provided with a pin, whose head projects from the face oriented towards the centre of the case to co-operate with a notch made in the top portion of the casing ring to allow the position of said casing ring to be indexed, i.e. to align its through passages perfectly with those provided in the middle part and in the segments for the passage respectively of the time-setting stem and the segments. In order not to weaken the segment concerned, this pin is preferably arranged beside the threaded hole for the push buttons sleeve and not above the latter. Likewise, the pin could be replaced by a stud integral with the segment.

Moreover each segment includes, in the bottom portion of its face oriented towards the centre and in a zone not located in proximity to the threaded hole, a groove parallel to the back cover, wherein is engaged by unscrewing, the head of a screw with an off-centre head previously screwed in a recess of the wall of the casing ring which thus becomes secured to the segments and the middle part-bezel.

As indicated at the beginning, the number of these multi-functional separated segments depends on the number of push buttons. According to a preferred embodiment, the chronograph watch includes four push buttons arranged at 2 o'clock, 4 o'clock, 8 o'clock and 10 o'clock and thus four segments which will occupy 50 to 60% of the recess of the middle part-bezel, or even less.

Other features and advantages of the present invention will appear more clearly upon reading the detailed description of an embodiment of a chronograph watch with an analogue display which also includes two small windows for a digital display, this description being made with reference to the annexed drawings, in which.

It is first of all to be noted that the description hereinafter is made by describing the parts useful to the invention in the order in which they are used to arrive at the finished product.

Figure 1:
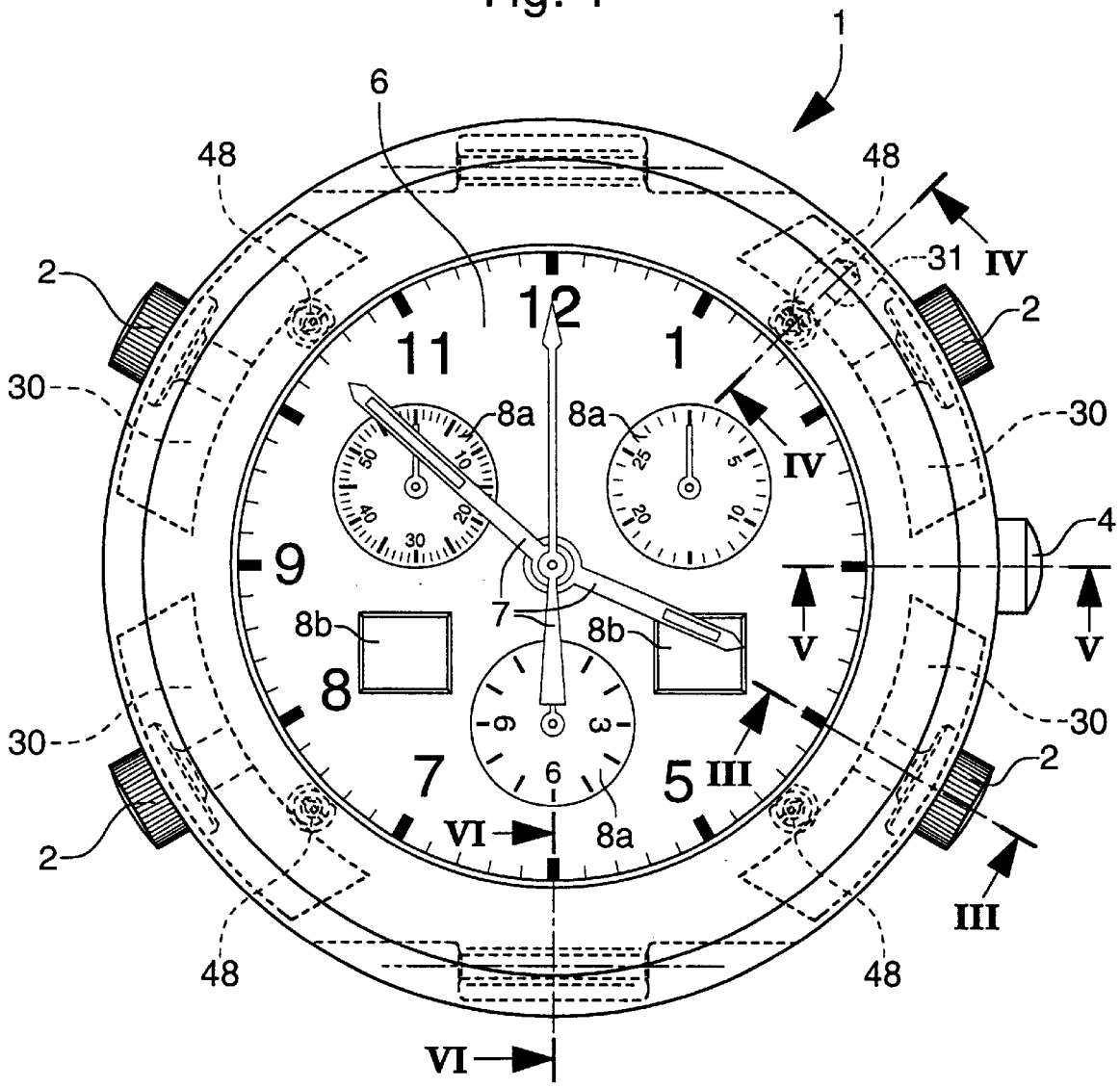
FIG. 1 is a top view of the chronograph watch.
Figure 3:
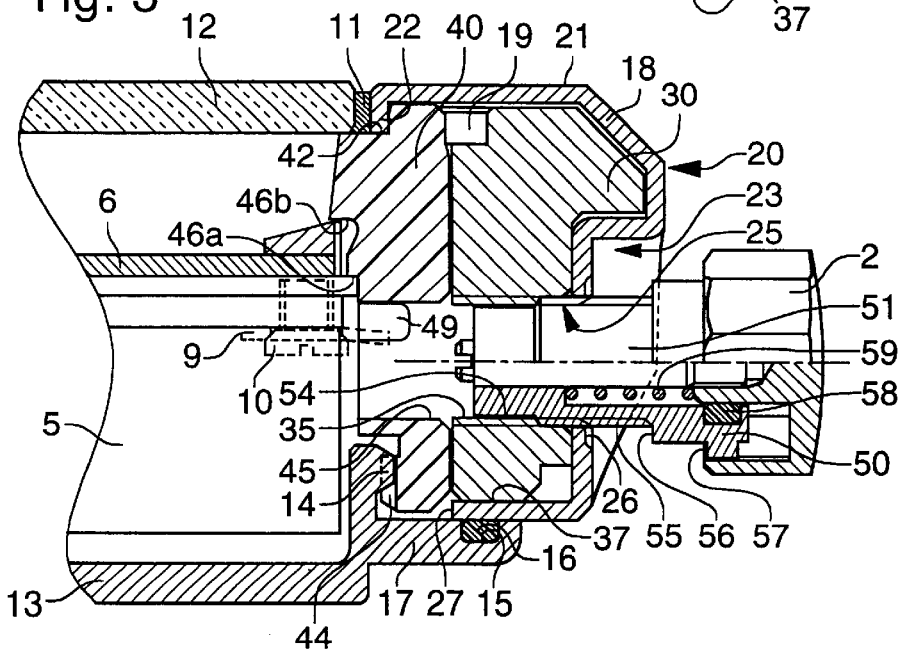
FIG. 3 is a cross-section of a partially dismantled push button, along the line III—III of FIG. 1.
Figure 4:
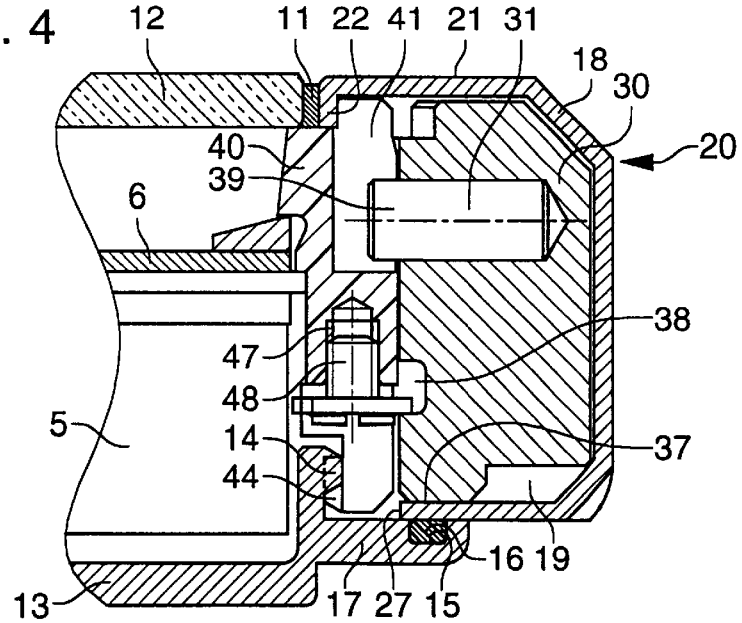
FIG. 4 is a cross-section of a the indexing pin, along the line IV—IV of FIG. 1.

Referring more particularly to FIGS. 1 and 3, it can be seen that the chronograph watch includes a case 1, whose monoblock middle part-bezel 20 made of precious metal such as gold is closed by a crystal 12 and a back cover 13. This case is intended to accommodate a chronograph movement 5 and its display device including a dial 6 which, in a conventional manner, has hands 7 and counters 8*a*, as well as two small windows 8*b* for a digital display. The external control elements include four push buttons 2, arranged at the 2 o'clock, 4 o'clock, 8 o'clock, 10 o'clock positions and a time-setting stem 4.

Middle part- bezel 20 has over its entire periphery a recess 19 oriented towards the centre of case 1 and delimited by a wall 18 having substantially the same thickness at each point of the order of 400 $\mu$m, which already gives it sufficient rigidity to resist shocks and pressure without it being necessary to provide reinforcing ribs. This middle part-bezel 20 is advantageously obtained via the electroforming technique which easily allows hollow deformed portions 23, 24 to be made in wall 18, intended respectively to partially house the heads of push buttons 2 (FIG. 3) and the crown of winding stem 4 (FIG. 5) as well as a recessed conformation 28 provided with a through passage 29 for securing a wristband (FIG. 6).

Hollow deformed portions 23 include a circular opening 25 for the passage of the mechanism of push button 2 including a sleeve 50 inside which slides a stem 51 extended on the exterior by a head.

Figure 5:
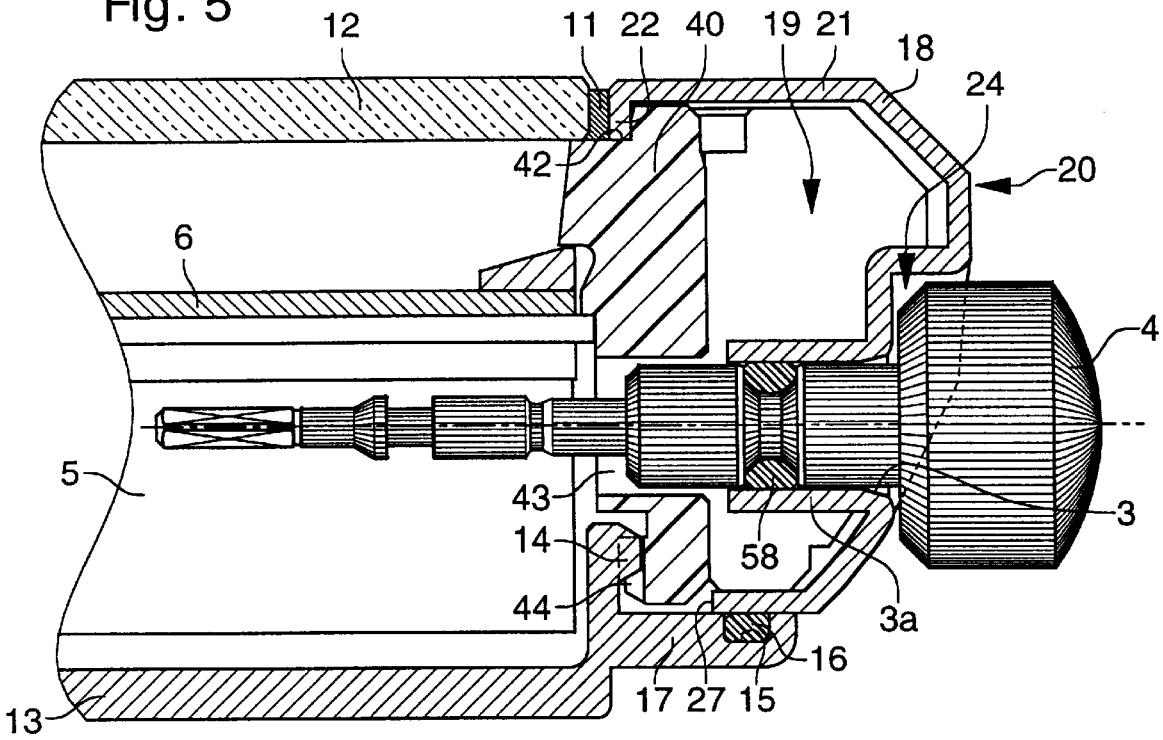
FIG. 5 is a cross-section of the time-setting stem along the line V—V of FIG. 1.
Figure 6:
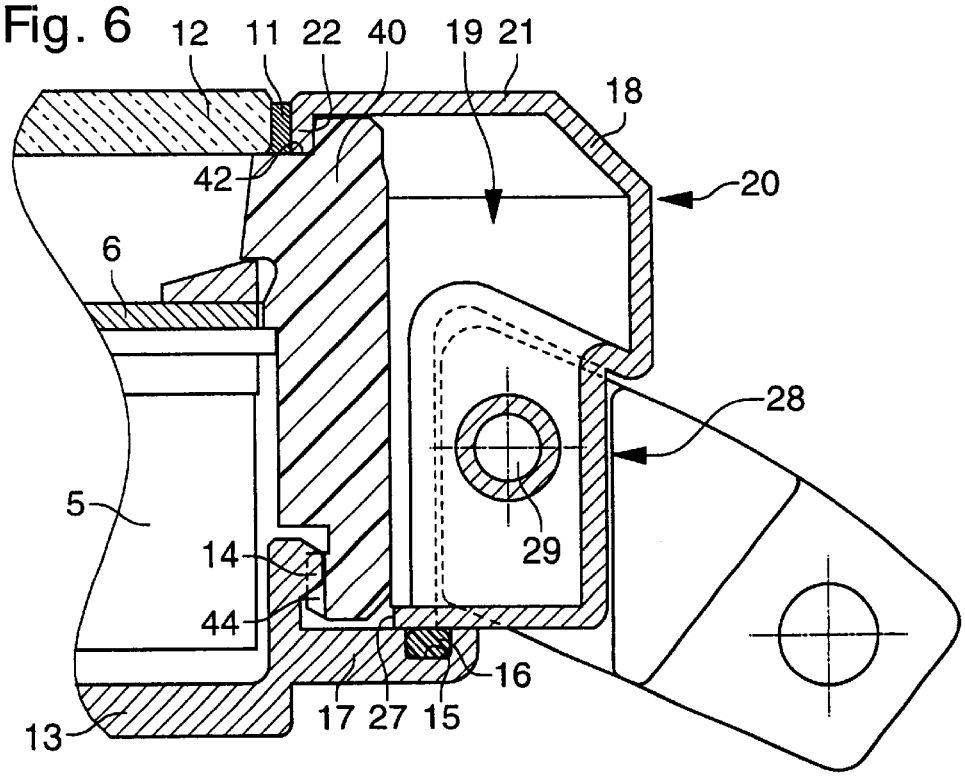
FIG. 6 is a cross-section of the wristband attachment, along the line VI—VI of FIG. 1.

As is seen in FIG. 5, hollow deformed portion 24 includes a circular opening 3, extended by a tube 3*a* integral with wall 18 and having the same thickness as the latter to allow winding stem 4 to be guided and to assure the sealing thereof.

The top portion of middle part-bezel 20 constitutes the actual bezel 21 and includes a bent edge 22 which allows the sealing of crystal 12 to be assured as will be explained hereinafter. The bottom portion includes at least one ring 17 parallel to back cover 13 which allows the sealing thereof to be assured.

Referring more particularly to FIGS. 1 to 4, one will describe hereinafter how segments 30, arranged in the vicinity of push buttons 2, constitute an indispensable linking element for assembling the various components of the chronograph watch. FIG. 1 shows that four segments 30 are set in place in recess 19, in the vicinity of push buttons 2, that they are separated and they each occupy an angular sector of approximately 50%, namely substantially 55% of recess 19, i.e. they have a very incidental role as regards the rigidity of the middle part or the unnecessary increase in the weight of the timepiece as a whole. These segments 30 are made of a base metal, but however have good mechanical properties, such as brass, to allow a threaded through passage 35 to be made in the substantially median portion, provided to coincide with opening 25 of middle part-bezel 20. The positioning of these segments, which constitutes the first assembly step, is facilitated by a depression 33 formed in the outer face 32 of the segment and shaped to match perfectly hollow deformed portion 23 of wall 18 of middle part-bezel 20. This pre-positioning of segments 30 then allows a casing ring 40 to be engaged, having not threaded through holes 43 and 45, respectively for the passage of time-setting stem 4 and for the mechanisms of push buttons 2. This casing ring 40 also includes in its bottom portion (on the side of back cover 13) the notches of the bottom of which openings 47 are made for setting in place off-centre headed screws 48.

These off-centre screws 48 are distributed in the casing ring in the same way as through holes 45, but are offset angularly with respect thereto.

Figure 2:
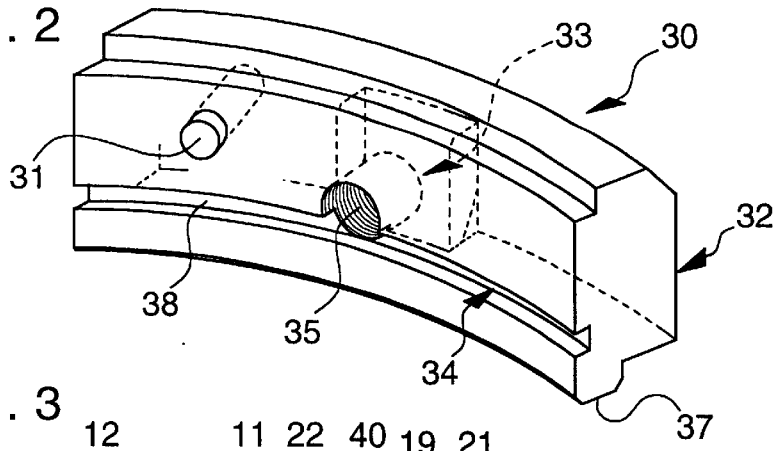
FIG. 2 is a perspective view of a segment.

The off centre part of these off-centre screws is provided so as to rest against the bottom of a groove 38 arranged in a segment 30 in its face 34 oriented towards the interior of case 1. For series production of the segments, for example by cutting out the machined segments from a same brass ring, it is advantageous for groove 38 to extend from one end of the segment to the other. It is also possible for the groove to be blind by being machined only at the location of the off-centre headed screw 48 with which it co-operates, in its top portion on the crystal side, casing ring 40 includes an annular shoulder 42 which allows said top portion to match the contour of the inner face of bezel 21 and its bent edge 22. When unscrewed, off-centre headed screw 48 rests on the bottom of groove 38 and blocks casing ring 40 against the inner face of bezel 21. In order to facilitate the alignment of openings 3 and 25 in middle part-bezel 20, of threaded through passages 35 in segments 30 and holes 43 and 45 in the casing ring, the casing ring includes a notch 41 in which engages an indexing pin 31 driven into face 34 of one of segments 30 in its top portion and substantially above groove 38. Similarly, the function of pin 31 could be fulfilled by a stud integral with segment 30, in particular in the event that the brass rough part is obtained by moulding. FIG. 2 shows segment 30 having an indexing pin 31 which, in the example chosen, is the segment positioned at 2 o'clock. The three other segments have exactly the same shape, but do not have an indexing pin.

In the next assembly step, more particularly illustrated in FIG. 3, sleeves 50 are screwed from the exterior into threaded through passages 35 of segments 30. These sleeves have a smooth tube portion 54, whose length is substantially the thickness of casing ring 40, a portion of threaded tube 55 the length of which is substantially the thickness of one segment 30 at a threaded through hole 35, a first shoulder 56 and a second shoulder 57 used to guide the push button head in a known way, the sealing of which is assured at this point by a sealing gasket 58 housed in a groove formed inside the sleeve. It will also be observed that, in a way known for mounting a push button, the through passage of the socket has a larger inner diameter on the push button side so as to be able to house a return spring 59.

When a sleeve 50 is screwed in, not only is a segment 30 precisely positioned to allow the other parts to be assembled, but shoulder 56 also compresses a ring 26 at the periphery of opening 26. Given the ductility of the precious metal, such as gold, forming the middle part, this screwing operation deforms the middle part along a ring 26 and assures satisfactory water resistance or sealing, without it being necessary to insert a gasket.

It thus appears clearly that segments 30 and sleeves 50 which block them are indispensable for the construction of the chronograph watch according to the invention, not only as regards sealing, but also as regards the assembly of the other components, beginning with casing ring 40. In the foregoing, it is evident that two assembly steps could for example be reversed: segments 30 being blocked first with sleeves 50, then casing ring 40 being set in place.

Whatever assembly order has been followed to this point, one need only engage movement 5, pre-assembled with its dial 6 and its display 7, 8, in the casing ring. This assembly is blocked by a flange 9 engaged in a recess 49 of the casing ring and secured by a screw 10. The levels of dial 6 and movement 5 are positioned by annular shoulders 46*a*, 46*b* of casing ring 40. One need only then engage the stem of push button 2 in sleeves 50, this operation having been anticipated in the drawing of FIG. 3. Since this assembly is conventional and does not in itself form part of the invention, it will not be described further. Likewise, time-setting stem 4 is set in place, while observing, with reference to FIG. 5 that it is guided only by a guide tube 3*a* having the same thickness as wall 18 of the middle part and extending opening 3, and that there is no need to reinforce the recess of the middle part at this location. This time-setting stem passes through passage 43 of casing ring 40 and has a groove inside which is arranged a sealing gasket 58 abutting against the inner surface of guide tube 3*a*.

The assembly then is continued with the setting in place of a crystal sealing gasket 11 which is compressed radially by crystal 12 against bent edge 22 of middle part-bezel 20, i.e. indirectly against casing ring 40.

In a final step, the back cover is screwed on, said cover including a ring 14 having a threading towards the exterior corresponding to threading 44 of the casing ring, said ring being extended by a ring 17 provided with a groove 15 close to its periphery for accommodating a sealing gasket which is compressed axially against an annular portion 27 of the bottom of middle part-bezel 20, which assures sufficient sealing even when recess 19 does not include any segments, as is visible in FIGS. 5 and 6.

What is claimed is:

1. A chronograph watch made of precious metal including a case, closed by a crystal and a back cover resting on a rigid middle part-bezel having a recess opened towards the centre of the case and wherein are provided through passages for a time-setting stem and for guide sleeves for at least two push buttons, and a chronograph movement with its display device positioned in said case by a casing ring arranged between said movement and said middle part-bezel, wherein the guide sleeves include a tube threaded on the outside and which ends in a collar and wherein at least two separated segments shaped substantially like the recess and pierced with a threaded hole are arranged in the vicinity of the push button sleeves to assure, by screwing from the exterior, both that said segments are firmly positioned and that said sleeves are sealed by crushing a metal ring of the middle part-bezel around the through passages.

2. A chronograph watch according to claim 1, wherein one of the segments includes in its top portion on the crystal side, a pin whose head projects from the face of said segment oriented towards the centre of the case to co-operate with a notch made in the top portion of the casing ring to allow its position to be indexed with respect to the openings made in the middle part-bezel in the segments.

3. A chronograph watch according to claim 1, wherein each segment further includes, in its face oriented towards the centre of the case and along a plane parallel to the back cover, a groove in which engages, by being screwed, the head of an off-centre headed screw previously screwed into a housing of the wall of the casing ring securing said casing ring to the segments and the middle part-bezel.

4. A chronograph watch according to claim 1, wherein the casing ring includes in its portion oriented towards the centre of the case a threading which co-operates with the outer threading of a ring secured to the back cover, said back cover being extended radially by a ring extending under an annular portion of the bottom portion of the middle part-bezel.

5. A chronograph watch according to claim 1, including four push buttons and four segments arranged at the 2 o'clock, 4 o'clock, 8 o'clock and 10 o'clock occupying 50 to 60% of the recess of the middle part-bezel.

6. A chronograph watch according to claim 1, wherein the segments are made of brass.

7. A chronograph watch according to claim 1, wherein the middle part-bezel and the back cover are made of gold and wherein they have a thickness comprised between 300 $\mu$m and 600 $\mu$m, preferably 400 $\mu$m.

* * * * *